US007137843B1

(12) United States Patent
Munoz

(10) Patent No.: US 7,137,843 B1
(45) Date of Patent: Nov. 21, 2006

(54) SYSTEM FOR OUTDOOR ELECTRICAL PROTECTION

(76) Inventor: Samuel Munoz, 5306 N. Lovejoy Ave., Chicago, IL (US) 60630-1212

( * ) Notice: Subject to any disclaimer, the term of this patent is extended or adjusted under 35 U.S.C. 154(b) by 0 days.

(21) Appl. No.: 11/113,903

(22) Filed: Apr. 25, 2005

(51) Int. Cl.
*H01R 13/627* (2006.01)

(52) U.S. Cl. ..... 439/367

(58) Field of Classification Search ..... 439/367; 174/84 R, 85, 84; 219/549
See application file for complete search history.

(56) References Cited

U.S. PATENT DOCUMENTS

| | | | | |
|---|---|---|---|---|
| 1,975,244 | A | 10/1934 | Wiseman | |
| 2,725,543 | A | 11/1955 | Tanner | |
| 3,014,194 | A | 12/1961 | Berglund | |
| 3,344,393 | A | 9/1967 | Hendee | |
| 4,643,505 | A | 2/1987 | House | |
| 4,869,683 | A | 9/1989 | Nelson | |
| 4,880,962 | A * | 11/1989 | Nolf et al. | 219/549 |
| 4,885,194 | A * | 12/1989 | Tight et al. | 428/34.9 |
| 5,221,815 | A * | 6/1993 | Bostock et al. | 174/84 R |
| 5,273,454 | A * | 12/1993 | Shotey | 439/367 |
| 5,505,634 | A | 4/1996 | Osten | |
| 5,958,529 | A * | 9/1999 | Myong et al. | 428/34.9 |
| 6,602,087 | B1 | 8/2003 | Carle | |

FOREIGN PATENT DOCUMENTS

| | | |
|---|---|---|
| CA | 2.269.384 | 10/2000 |
| WO | WO95/20830 | 8/1995 |

* cited by examiner

*Primary Examiner*—Phuong Dinh
(74) *Attorney, Agent, or Firm*—Michael I. Kroll

(57) ABSTRACT

A system for protecting exterior electrical connectors from moisture, dust, and foreign particles. A flexible polymer sleeve with a low temperature adhesive is provided to seal ends of the sleeve to the cord. Once the sleeve is sealed to the cords the electrical connection is protected from foreign particles such as moisture and dust. The sleeve is formed of flexible polymer material with a band of heat-activated glue on the inner diameter of both ends. The system includes a heat-generating sealing tool includes heated jaws that bond the polymer sleeve glue to the cord. The jaws include a range of sized apertures to suit different gauges of the cords to be sealed. The jaws include a heating element within the jaws to produce heat and electric current is generated by an incoming AC or DC power source.

12 Claims, 10 Drawing Sheets

SYSTEM FOR OUTDOOR ELECTRICAL PROTECTION

BACKGROUND OF THE INVENTION

1. Field of the Invention

The present invention relates generally to protection of electrical connections, and, more specifically, to a system to protect exterior electrical connections from moisture, dust, and other foreign particles.

Environmental conditions may create hazards for power and extension cords by providing dangerous pathways for electric current. Electrocutions are more likely to occur where electricity exists together with dampness and "grounded" objects.

Electricity is utilized in many outdoor applications for electrical cords, radios, power tools, and other equipment. Dampness is common due to rain, humidity, and water from livestock pens. People may also be damp from perspiration and wet clothing. The combination of dampness and electricity can be fatal, especially if a person is in contact with soil, concrete, metal fences, gates, pipes, conduit, or other grounded objects.

The outdoor protection system of the present invention provides means to protect the user and others from electrocutions by reducing the chance of foreign particles such as moisture and dust from contacting the connection points of a receptacle or plug.

The present invention provides a flexible polymer sleeve with a low temperature adhesive on either end to seal the ends of the sleeve to the cord. Once the sleeve is sealed to the cords the electrical connection is protected from foreign particles such as moisture and dust. The sleeve is comprised of flexible polymer material with a band of heat activated glue on the inner diameter of both ends. The sleeve may be of any diameter and length depending on the application.

Providing means to seal the polymer sleeve, the outdoor protection system of the present invention includes a heat generating sealing tool. The seal tool consists of heated jaws that provide means to bond the polymer sleeve glue to the cord. The jaws include a range of sized apertures to suit different gauges in the cords to be sealed. The jaws produce heat by means of a heating element contained within the jaws and electric current generated by an incoming AC or DC power source.

The flexible sleeve is positioned by sliding the sleeve over one of the cord ends prior to electrical connection. Once the sleeve is positioned, the electrical cords are joined and the sleeve is centrally position. The flexible sleeve is positioned such that the plugs for both electrical cord ends are centrally positioned between the glue lines on both ends of the sleeve.

Once in position, the sealing tool is positioned around one glue line on the sleeve and such the properly sized gauge jaw aperture aligns with the cord. With both alignments in position, the user squeezes the handle allowing the jaws to compress around the cord and heat is transferred from the tool to the glue. In turn, the flexible sleeve contracts around the cord creating a seal between the cord and the sleeve.

With the one end of the flexible polymer sleeve secured to the electrical cord, the user secures the opposing end of the sleeve to the second electrical cord in the same manner as the first. The sealing tool is positioned around the second glue line on the sleeve and such the properly sized gauge jaw aperture aligns with the cord. When in position, the user squeezes the handle allowing heat transfer from the tool to the glue.

With both ends of the flexible polymer sleeve affixed at the glue lines to the electrical cords, a barrier at the electrical connection is created protecting the connection from foreign particles such as moisture and dust.

Upon disconnection of a temporary electrical connection, the sleeve barrier may be removed by cutting the polymer material with a utility knife or the like, and peeling the sleeve away from the cord.

2. Description of the Prior Art

There are other devices designed for outdoor protection of electrical connectors. Typical of these is U.S. Pat. No. 1,975,244 issued to John T. Wiseman on Oct. 2, 1934.

Another patent was issued to Henry G. Tanner on Nov. 29, 1955 as U.S. Pat. No. 2,725,543. Yet another U.S. Pat. No. 3,014,194 was issued to Wilhelm Axel Berglund on Dec. 19, 1961 and still yet another was issued on Sep. 26, 1967 to Howard R. Hendee as U.S. Pat. No. 3,344,393.

Another patent was issued to David N. House on Feb. 17, 1987 as U.S. Pat. No. 4,643,505. Yet another U.S. Pat. No. 4,869,683 was issued to Llewellyn W. Nelson on Sep. 26, 1989. Another was issued to Frederick F. Osten on Apr. 9, 1996 as U.S. Pat. No. 5,505,634 and still yet another was issued on Aug. 5, 1993 to Denis A. Carle as U.S. Pat. No. 6,602,087.

Internationally, a patent was issued to Christ Bastiaansen on Aug. 3, 1995 as International Patent Application Number WO 95/20830. Yet another Canadian Patent Number CA 2,269,384 was issued to Raymond H. Clements on Oct. 21, 2000.

U.S. Pat. No. 1,975,244

Inventor: John T. Wiseman.

Issued: Oct. 2, 1934

This invention improvements relate to joints for electrical conductors, and are more particularly designed to provide a reliable union for cables and the like, having a multiplicity of wires, although they are not limited to such applications. A primary object of the improvements, among others, is to provide a novel joint for electrical conductors which will maintain the sections of the conductor in an intimate contact, mechanically as well as conductively.

U.S. Pat. No. 2,725,543

Inventor: Henry G. Tanner

Issued: Nov. 29, 1955

The invention relates to a coupling for electrical plug connectors and it consists in the combinations, constructions and arrangements of parts herein described and claimed. Generally the invention comprises a pair of deformed strap-like members each of which is provided with a pair of buttons and a pair of key slots for engaging the same buttons. The pair of straps may be interconnected about a male and female plug connection to insure the electrical plugs remaining so connected.

U.S. Pat. No. 3,014,194

Inventor: Wilhelm Axel Berglund

Issued: Dec. 19, 1961

The primary object of the invention is the provision of an efficient and practical device of the kind indicated which is waterproof and dirt-proof, and which imposes the strains which produce separation of the components of the connector, on the cables of the components, rather than on the components, whereby a cable equipped with the device can be roughly handled and pulled through water puddles and dirt under severe service conditions, such as on out door construction projects, without incurring separation of the components of the connector and without danger of short circuits and electrical shock to workmen.

U.S. Pat. No. 3,344,393

Inventor: Howard R. Hendee

Issued: Sep. 26, 1967

A housing for an electrical connector of the type commonly associated with extension cords which will transfer tension from the connected sections of wire around the connector components, and will also shield the components against accidental contact of other possibly conductive articles to prevent shorting.

U.S. Pat. No. 4,643,505

Inventor: David N. House

Issued: Feb. 17, 1987

A housing is provided for maintaining the plugs of a pair of extension cords connected. The housing includes first and second members which are connected by a hinge along one edge. The interior surfaces of each of the first and second members include a series of grooves distributed along the length of the members. Retaining washers are designed to be engageable with the grooves to hold the plugs of a connected pair of extension cords in engagement.

The provision of a series of grooves permits the housing to be adapted for use with a wide range of plug lengths. The slots in the retaining washers are designed so that the cable passing therethrough is slightly offset from the central axis to resist motion in the plugs. After the retaining washers have been positioned in the first and second members, the first and second members are pivoted about the hinge into abutting relationship and maintained therein by flexible hooks to form a capsule having a streamlined shape which resists entanglement in obstructions during use.

U.S. Pat. No. 4,869,683

Inventor: Llewellyn W. Nelson.

Issued: Sep. 26, 1989

A device is provided for protectively enclosing coupled terminals of mated industrial gauge electrical cords. The device, which can accommodate terminals and cords of varying size, easily creates a water-impervious shield encompassing the coupled terminals. The device is comprised of a flexible sheath having two longitudinal edges interengageable by a zipper to form a tubular structure. Binding straps disposed upon the exterior surface of the sheath adjacent each tubular extremity apply compressive force to underlying sealing bands which grip the electrical cord.

U.S. Pat. No. 5,505,634

Inventor: Frederick F. Osten

Issued: Apr. 9, 1996

An electrical cord connector for holding together a male electrical plug and a female electrical plug wherein the connector includes two one-piece receptacle-like members with their side walls forming conic threads such that the members may be threaded securely together to prevent the male and female electrical plugs from being pulled apart and if desired provide a water resistant environment for the male and female electrical plugs.

U.S. Pat. No. 6,602,087

Inventor: Denis A. Carle

Issued: Aug. 5, 1993

A male coupling connector has a first half male portion and a second half male portion, which are hinged together between open and closed positions. A female coupling connector has a first half female portion and a second half female portion, which are hinged together between open and closed positions. The female connector is sized to be slidably positioned and securely interconnected about the male connector in a closed position at assembly, to enclose an in-line electrical plug and socket therein. Ridges and grooves extend in parallel, side by side relation about the outer circumference of the first and second half male portions. Ridges and grooves extend in side by side relation about the inner circumference of the female connector. The ridges and grooves on the male coupling connector interlock with the ridges and grooves on the female connector portion. The male coupling connector is pivotally closed and releasably secured about a portion of the in-line electrical plug and socket. The female coupling connector is then adjustably positioned and releasably secured about the male coupling connector to adjust the length of the electrical cord connector to suit the length of the socket and plug, to prevent disconnection during use.

International Patent Application Number WO 95/20830

Inventor: Christ Bastiaansen

Issued: Aug. 3, 1995

The invention relates to a spatter and dust proof plastic case to cover plug combinations such as used to connect electrically driven hand tools, vacuum cleaners etcetera, to the mains by means of an extension card. The case prevents the plugs from being disconnected by cable tension during use and—something very dangerous—in sport by infants. The case according to this invention meets also these requirements and can be opened by adults only because this handling needs a certain amount and direction of force to be applied to the fastener. Other cases designed for said purposes and already existing are frequently leaking, especially adjacent to hinge and click fastener system. This invention however provides for spatter tight and dust proof protection because of an inventive lapping square gasket on these spots. As long as the case remains closed, sufficient gasket pressure to achieve adequate sealing will be available and maintained by the click fastener.

Canadian Patent Number CA 2,269,384

Inventor: Raymond H. Clements

Published: Oct. 21, 2000

This invention relates to a device and method for preventing the accidental separation of interconnected cords, such as an electrical cord connected to an extension cord. The device consists preferably of a single piece of an elastic material with two apertures, spaced so that the distance between the apertures is less than or equal to the length of an interconnected male plug and female socket. A male plug and a female socket are inserted through each of the apertures on the same face of the device, then the plug and socket are connected together while stretching the device. Once the plug and socket are connected, the elastic material is under tension and the connection will be severed only if sufficient tension is put on one of the cords to stretch the device past the length of the prongs.

While these electrical protection and securing devices may be suitable for the purposes for which they were designed, they would not be as suitable for the purposes of the present invention, as hereinafter described.

SUMMARY OF THE PRESENT INVENTION

The present invention discloses a system to protect exterior electrical connectors from moisture, dust, and other foreign particles. The present invention provides a flexible polymer sleeve with a low temperature adhesive on either end to seal the ends of the sleeve to the cord. Once the sleeve is sealed to the cords the electrical connection is protected from foreign particles such as moisture and dust. The sleeve is comprised of flexible polymer material with a band of heat-activated glue on the inner diameter of both ends. The system of the present invention includes a heat-generating sealing tool. The sealing tool consists of heated jaws that provide means to bond the polymer sleeve glue to the cord. The jaws provide means to bond the polymer sleeve glue to the cord. The jaws include a range of sized apertures to suit different gauges of the cords to be sealed. The jaws produce heat by means of a heating element contained within the jaws and electric current generated by an incoming AC or DC power source.

A primary object of the present invention is to provide system to protect exterior electrical connections from moisture, dust, and other foreign particles.

Another object of the present invention is to provide system to protect exterior electrical connections by covering the connection point of the cords with a sealable polymer sleeve.

Still yet another object of the present invention is to provide system that provides a flexible polymer sleeve with a low temperature adhesive on either end to seal the ends of the sleeve to the cord Yet another object of the present invention is to provide system to protect exterior electrical connections by sealing polymer sleeve to the cords by heat sensitive glue.

Still yet another object of the present invention is provide system to protect exterior electrical connections by sealing polymer sleeve to the cords by means of a heat generating tool.

Still yet another object of the present invention is to provide system that includes a sealing tool that provides means to secure the sleeve to various gauge (diameter) cords.

Yet another object of the present invention is to provide a protection system with a sealing tool that includes various apertures in the jaw to accommodate sealing of various gauge (diameter) cords.

Additional objects of the present invention will appear as the description proceeds.

The present invention overcomes the shortcomings of the prior art by providing means to protect the user and others from electrocutions by reducing the chance of foreign particles such as moisture and dust from contacting the connection points of a receptacle or plug. Additionally, by providing a flexible polymer sleeve with a low temperature adhesive on either end to seal the ends of the sleeve to the cord. Furthermore, by providing a heat generating sealing tool to seal the adhesive to the cords.

The foregoing and other objects and advantages will appear from the description to follow. In the description reference is made to the accompanying drawings, which form a part hereof, and in which is shown by way of illustration-specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
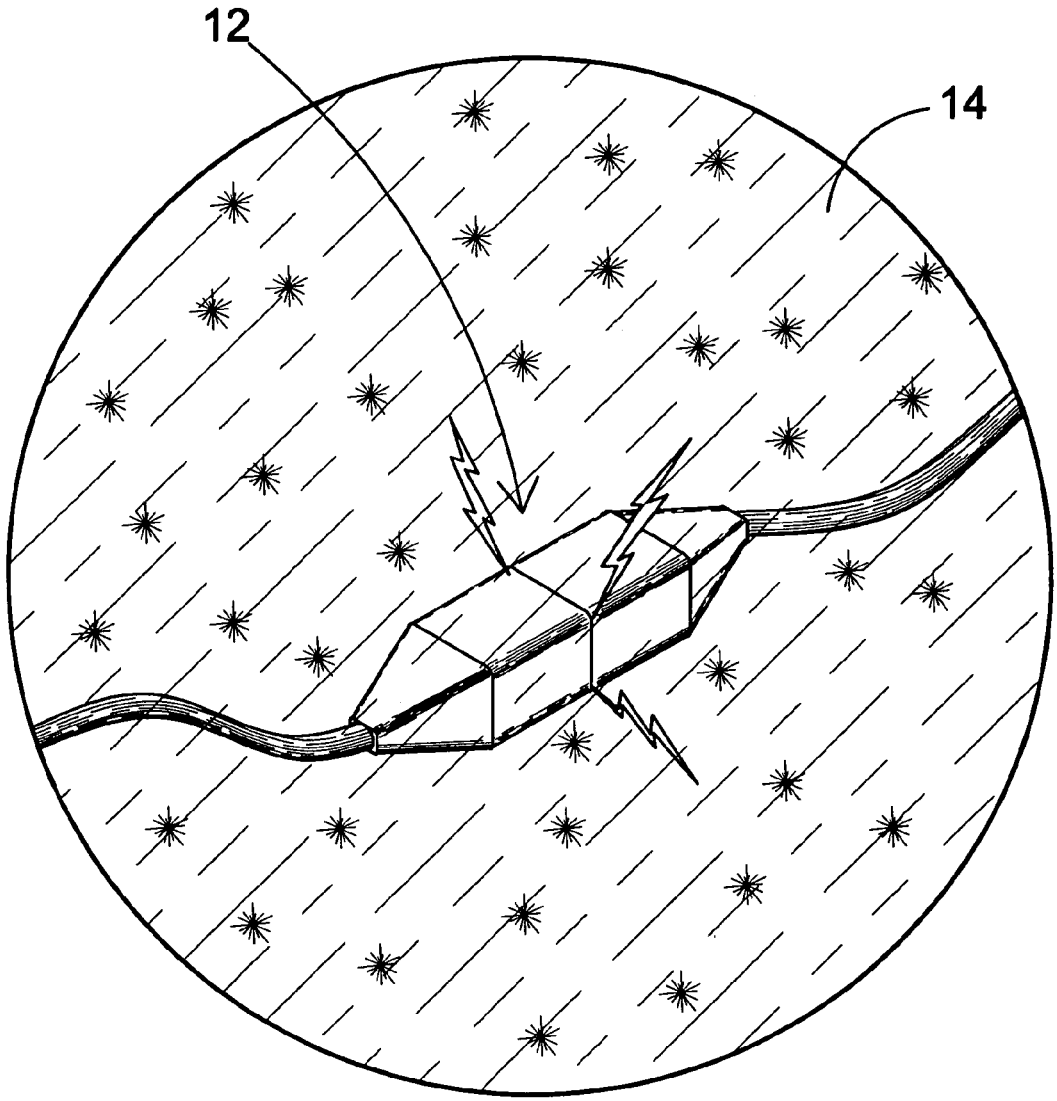
FIG. 1 is an illustrative view of prior art.

With regard to reference numerals used, the following numbering is used throughout the drawings.

10 present invention
12 prior art connector
14 rain
16 sleeve
18 seal
20 cord
22 heat-activated glue
24 sealing tool
26 heated jaws

28 120 VAC cord
30 handle
32 battery
34 cartridge heater
36 pivot stud
38 inner jaw
40 outer jaw
42 male connector
44 female connector
46 aperture of equal gauge
48 aperture of different gauge
50 location of heating element
52 face

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of prior art connectors 12. Standard electrical connectors 12 used for extension cords, decorations or power tools provide no means of protection from the elements when used outdoors. Water from rain 14, snow or garden hose can short circuit the connector 12 and damage the device. The present invention provides a method to waterproof an electrical connector 12 for outdoor use.

Figure 2:
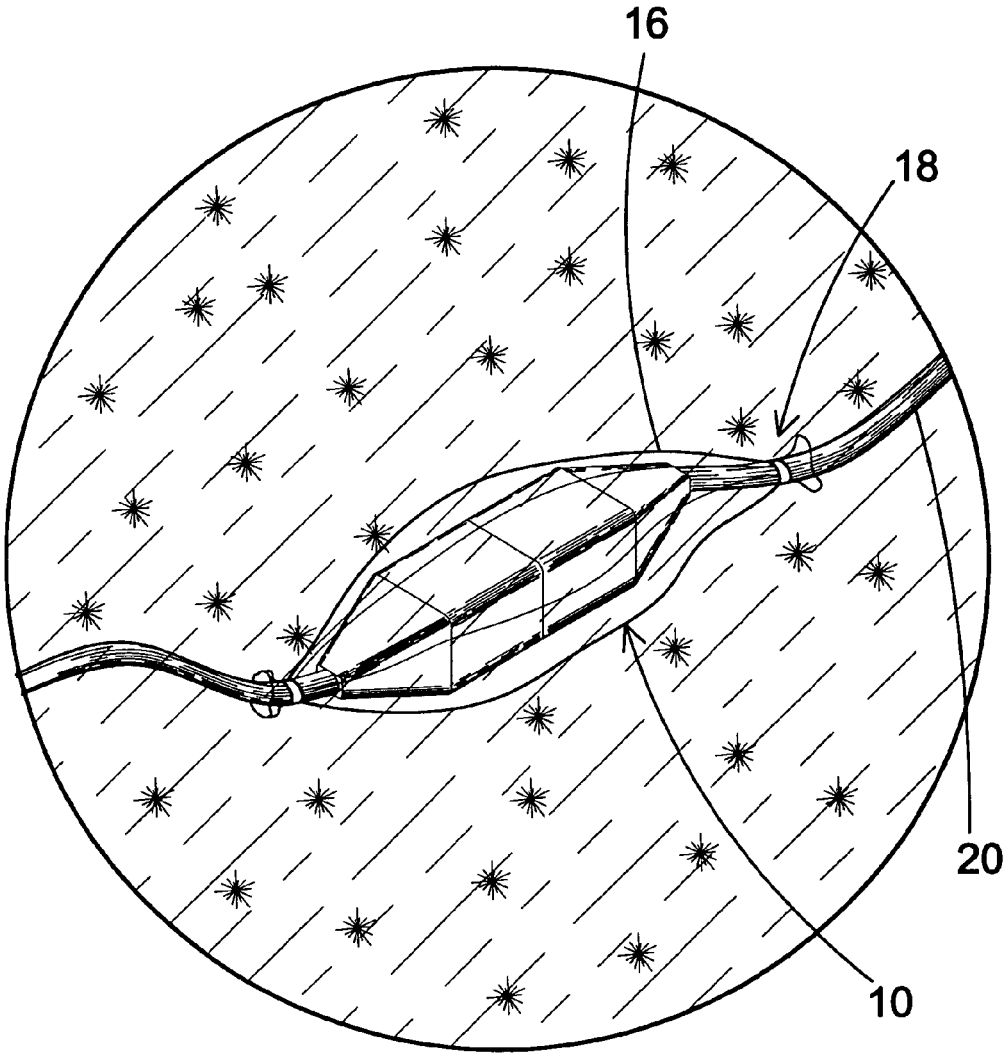
FIG. 2 is an illustrative view of the present invention.

Turning to FIG. 2, shown therein is an illustrative view of the present invention 10. The present invention 10 provides a polymer sleeve 16 with a low temperature adhesive on either end to seal at 18 the ends of the sleeve to the cord 20. Once the sleeve is sealed to the cords the electrical connection is waterproof.

Figure 3:
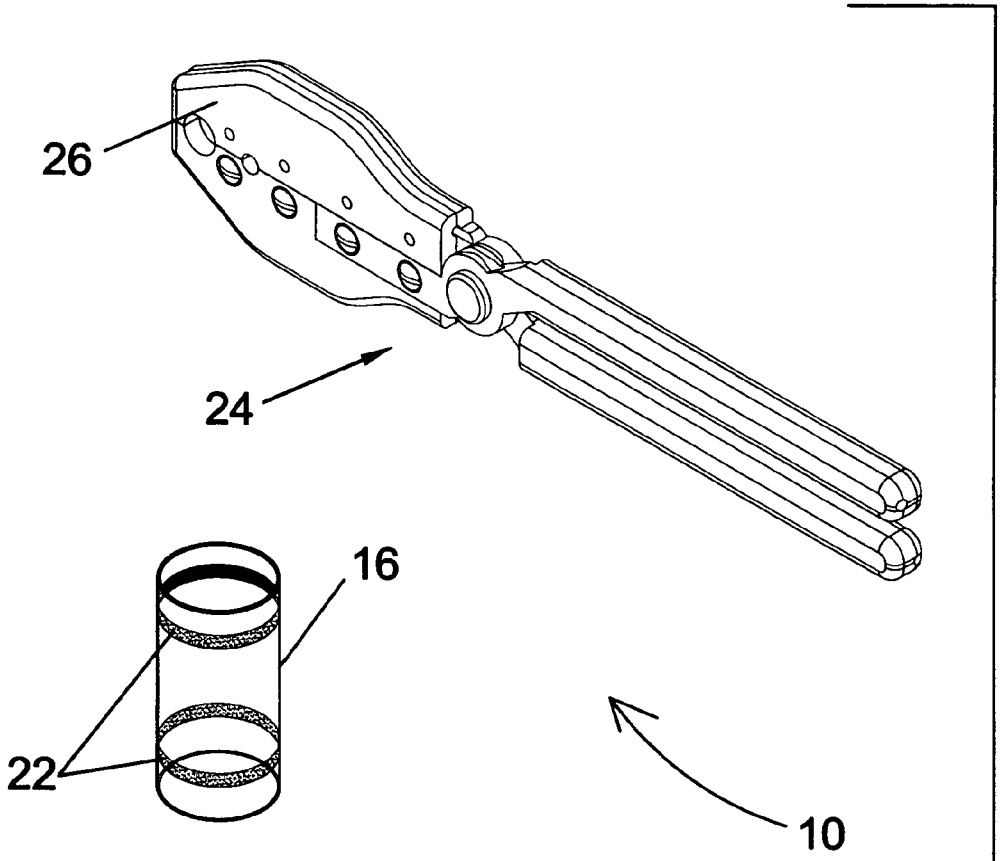
FIG. 3 is an illustrative view of the present invention.

Turning to FIG. 3, shown therein is an illustrative view of the present invention 10. The present invention 10 is comprised of a flexible polymer sleeve 16 with bands of heat-activated glue 22 on either end and a sealing tool 24 with heated jaws 26.

Figure 4:
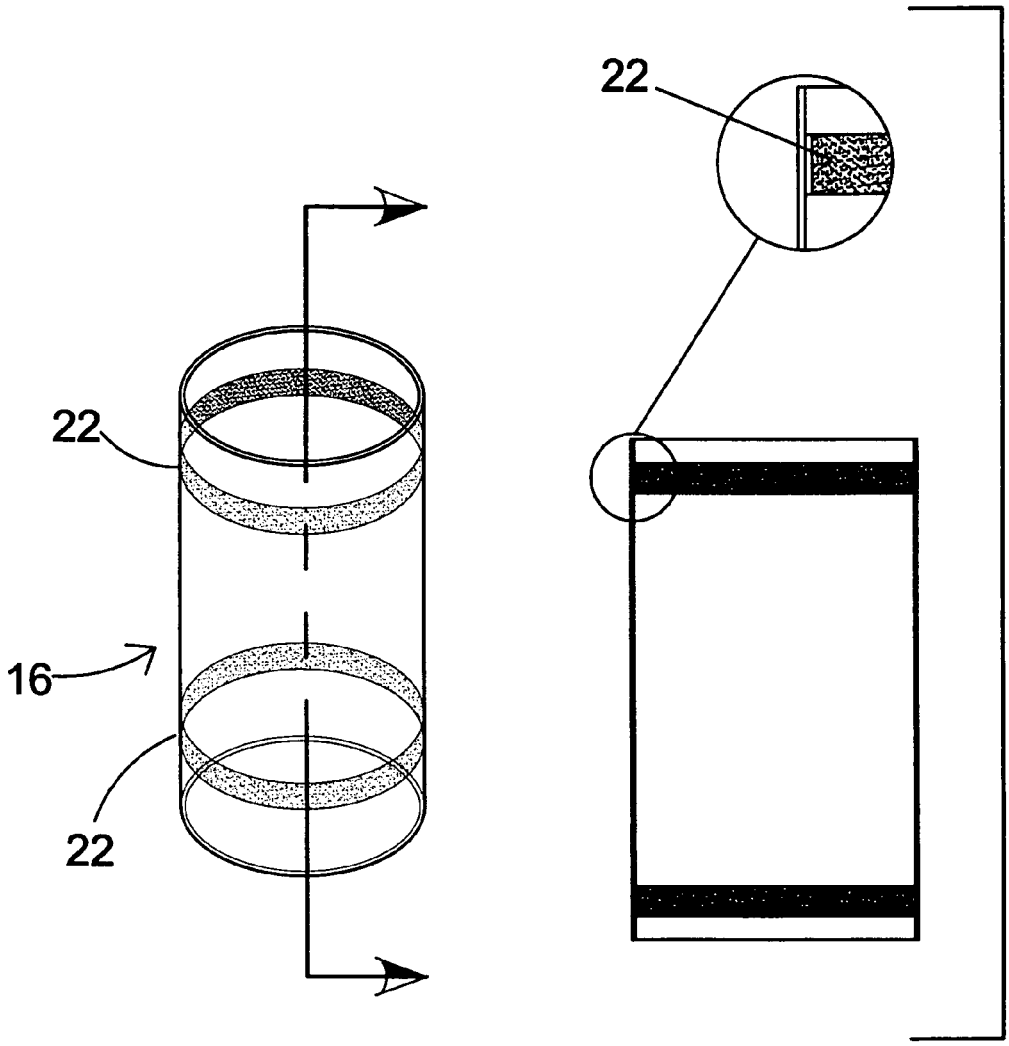
FIG. 4 is multiple views of the sleeve.

Turning to FIG. 4, shown therein is multiple views of the sleeve. FIG. 4 illustrates the flexible polymer sleeve 16. The sleeve 16 is comprised of flexible polymer material with a band of heat activated glue 22 on the inner diameter of both ends. The sleeve 16 may be of any diameter and length depending on the application.

Figure 5:
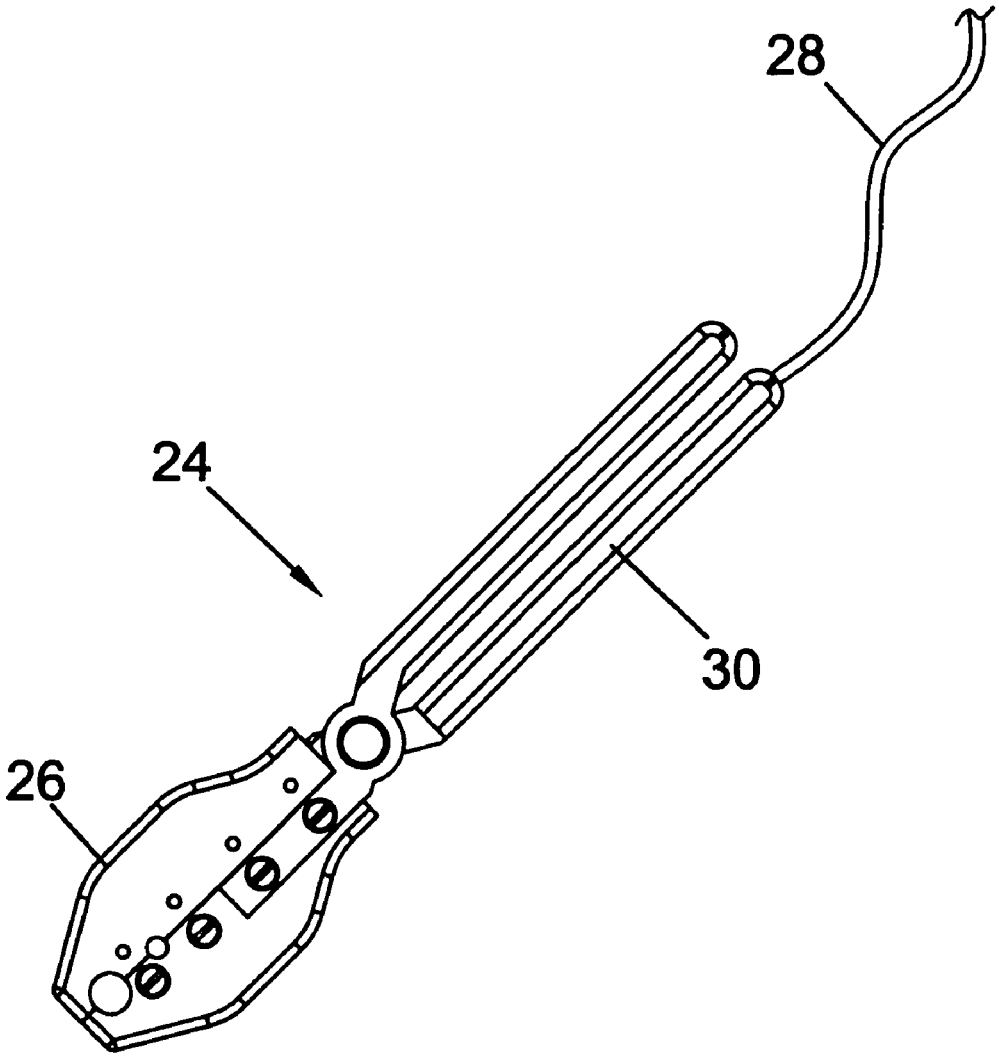
FIG. 5 is a side view of the sealing tool of the present invention.

Turning to FIG. 5, shown therein is a side view of the sealing tool of the present invention. FIG. 5 illustrates the sealing tool 24 of the present invention. The sealing tool 24 consists of heated jaws 26 that provide means to bond the polymer sleeve glue. The jaws 26 produce heat by means of electric current generated by an incoming 120 VAC power cord 28. Also shown are handles 30. Note that tool 24 is similar to a set of pliers.

Figure 6:
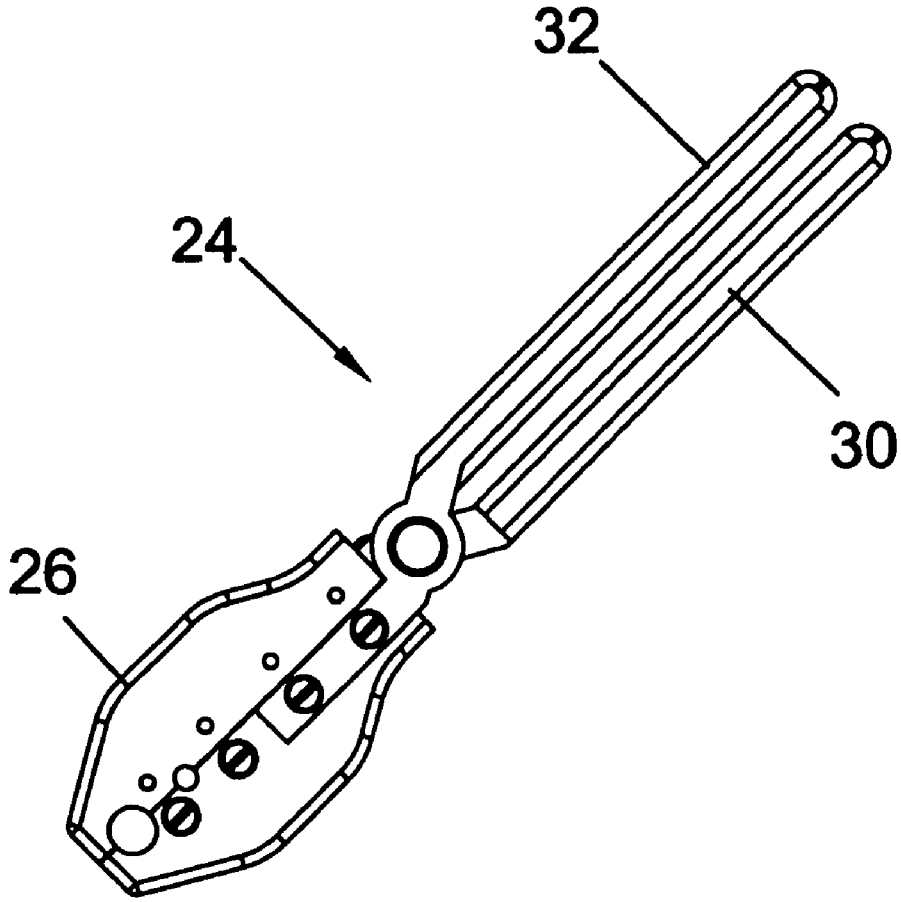
FIG. 6 is a side view of the sealing tool of the present invention.

Turning to FIG. 6, shown therein is a side view of the sealing tool of the present invention. FIG. 6 illustrates the sealing tool 24 of the present invention with alternate construction. In this embodiment, the power source used to transfer heat from the jaws 26 to the polymer sleeve glue is generated by dc current. A battery(s) 32 housed within the handle 30 of the sealing tool 24 provides incoming dc power used to transfer heat from the sealing to the polymer sleeve glue.

Figure 7:
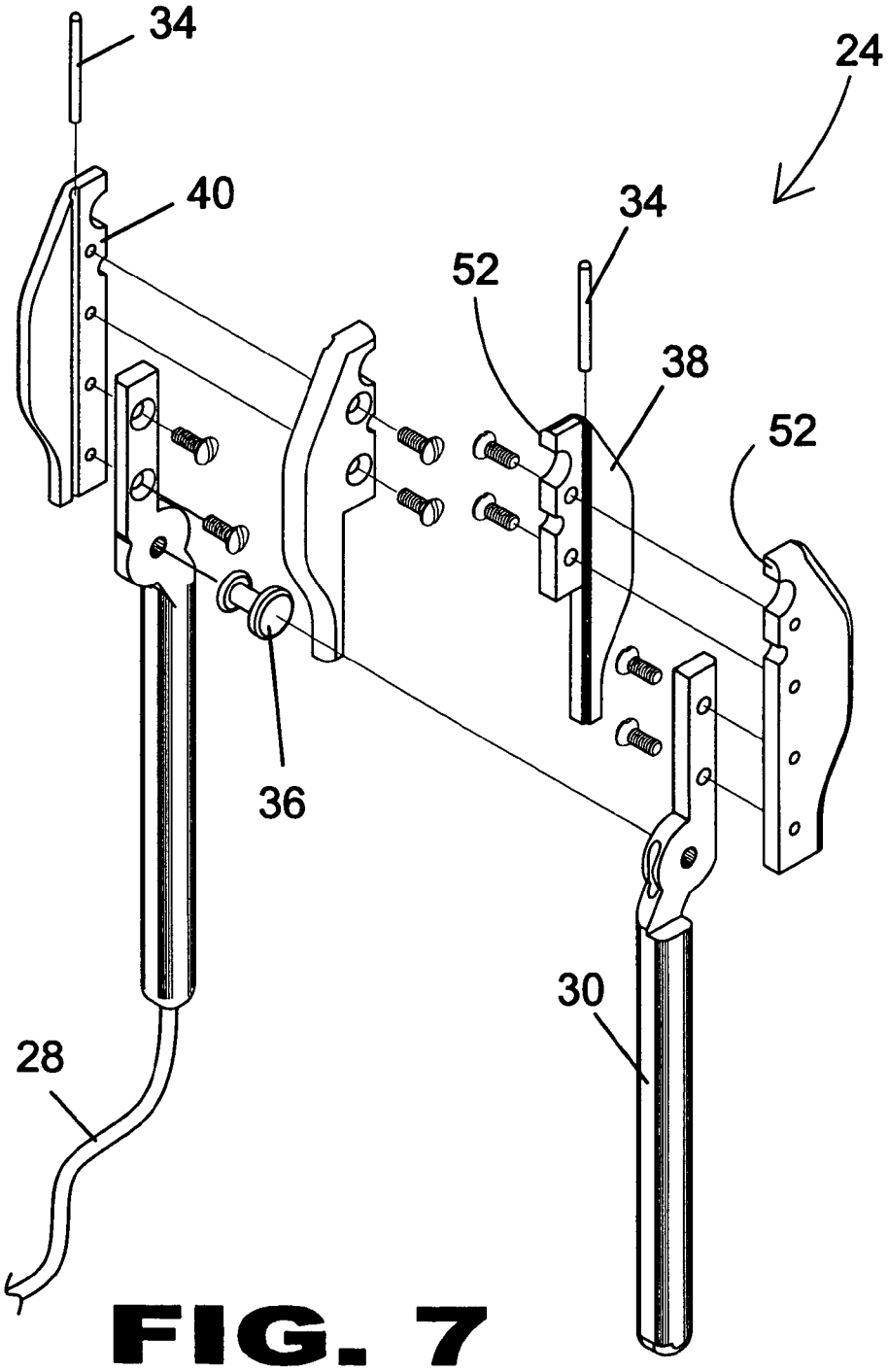
FIG. 7 is an exploded isometric view of the sealing tool of the present invention.

Turning to FIG. 7, shown therein is an exploded isometric view of the sealing tool of the present invention. Depicted in FIG. 7 are the components of the sealing tool 24. Cartridge heaters provide means for the heat transfer from the sealing tool jaws to the glue affixed to the flexible polymer sleeve. Typical of standard pliers, a pivot stud 36 provides means to actuate the jaws and apply pressure upon the sleeve and electrical cords. Also shown are inner jaw 38, outer jaw 40, power cord 28 and handle 30. Each jaw has a face 52 that has a portion of an aperture therein so that a complete aperture is formed when the jaws are closed.

Figure 8:
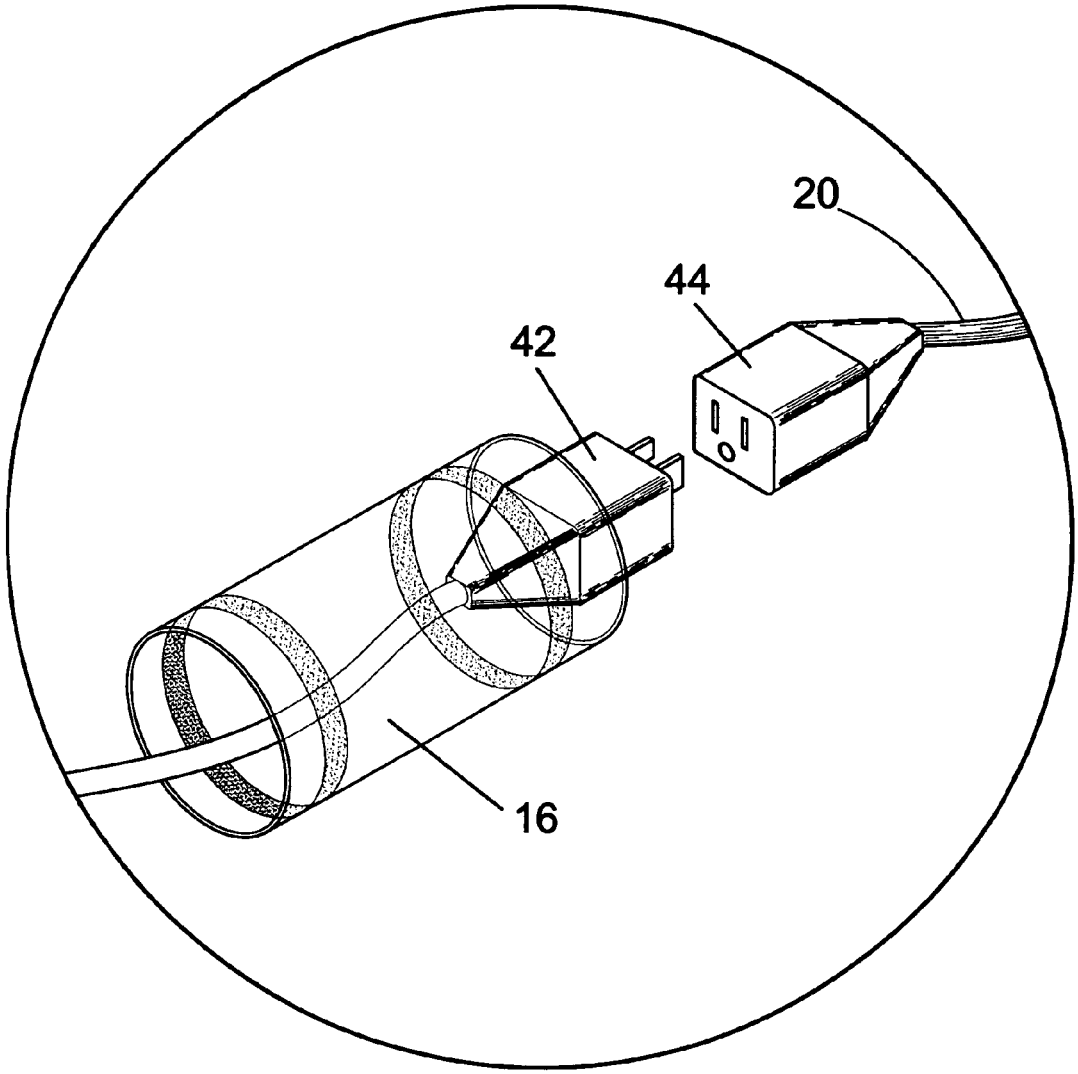
FIG. 8 is an isometric view of the sealing system of the present invention in use.

Turning to FIG. 8, shown therein is an isometric view of the sealing system of the present invention in use. Depicted in FIG. 8 is the flexible sleeve 16 being place upon the electrical cords 20 to be sealed. The flexible sleeve 16 is positioned by sliding the sleeve over one of the cord ends prior to electrical connection. Once the sleeve is positioned, the electrical cords are joined. Also shown are male 42 and female connectors 44.

Figure 9:
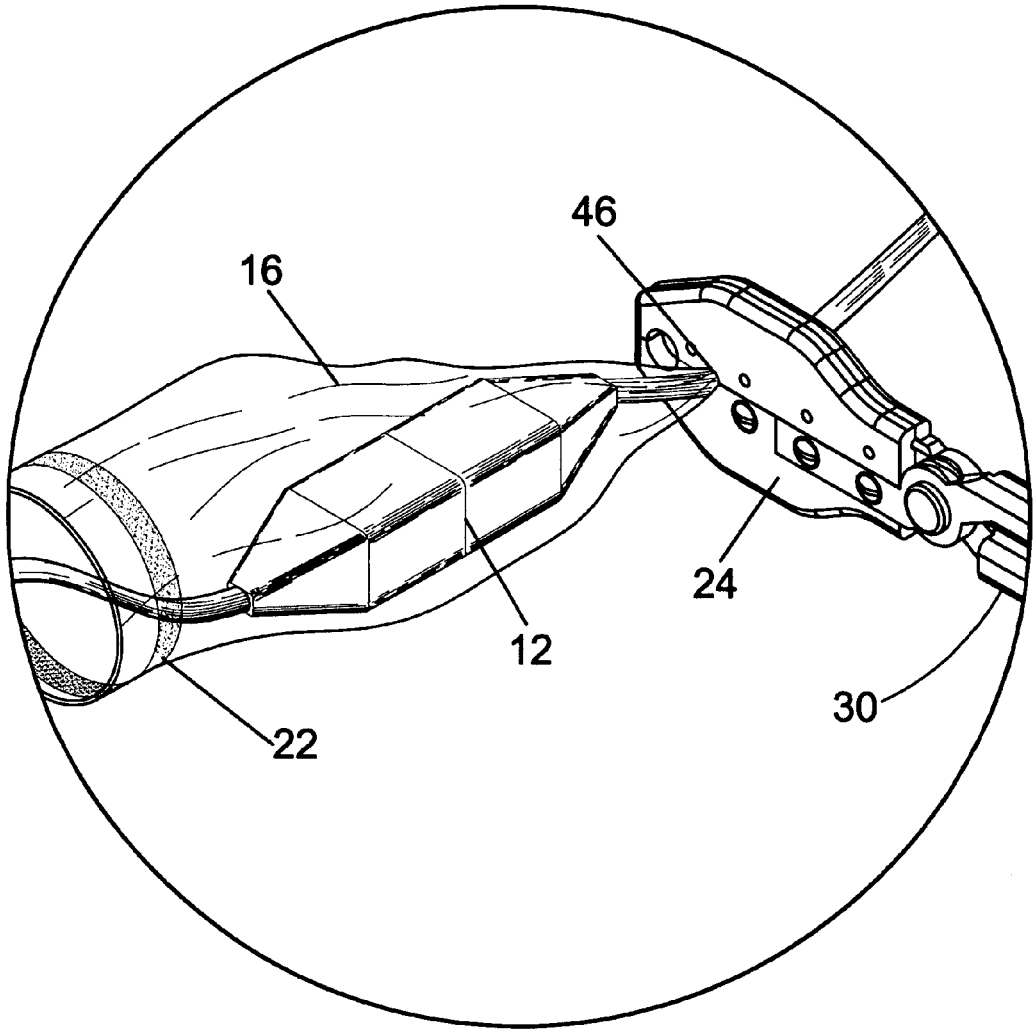
FIG. 9 is an isometric view of the sealing system of the present invention in use.

Turning to FIG. 9, shown therein is an isometric view of the sealing system of the present invention in use. Depicted in FIG. 9 is the flexible sleeve 16 being sealed upon the electrical cords connection. The flexible sleeve 16 is positioned such that the plugs or connectors 12 for both electrical cords are centrally positioned between the glue lines 22 on both ends of the sleeve. Once in position, the sealing tool 24 is positioned around one glue line 22 on the sleeve 16 and such the properly sized gauge jaw aperture 46 aligns with the cord. With both alignments in position, the user squeezes the handle 30 allowing heat transfer from the tool 24 to the glue 22.

Figure 10:
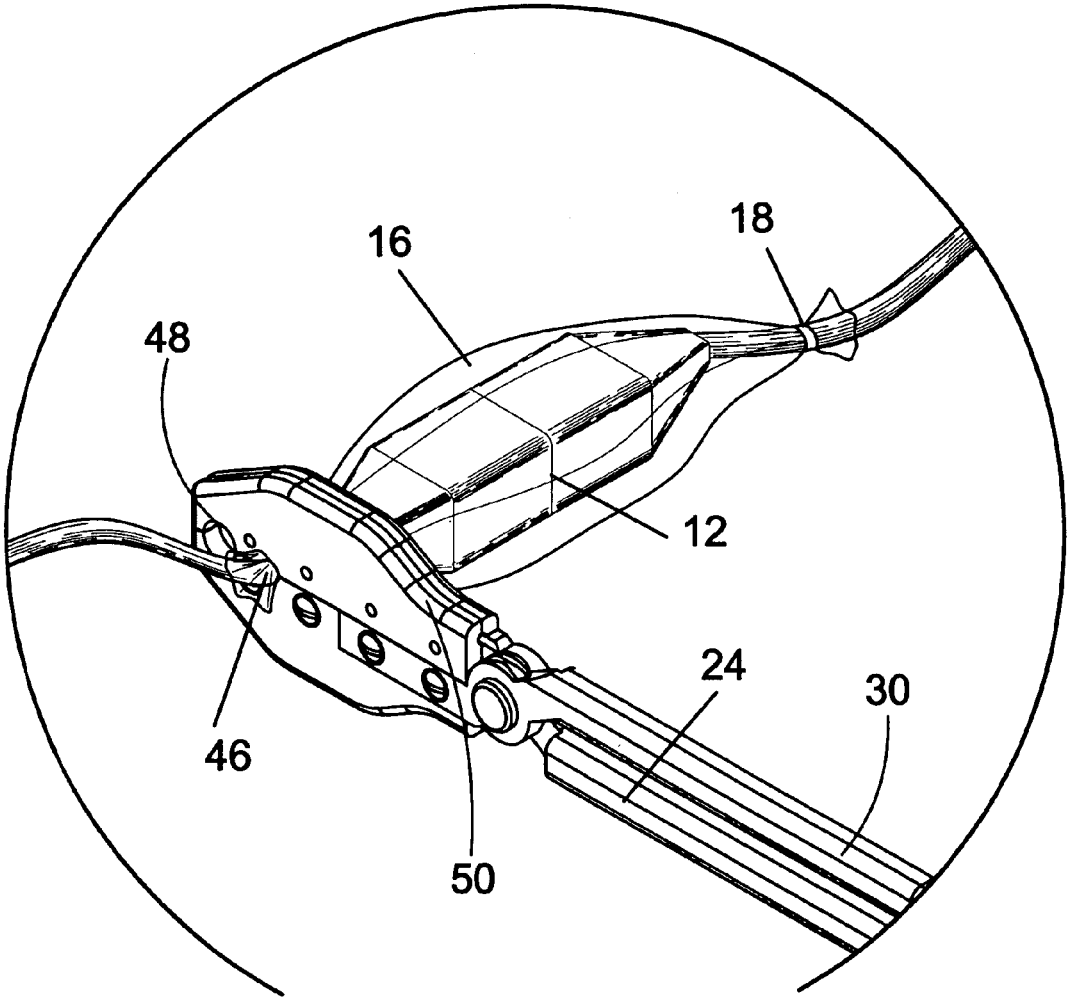
FIG. 10 is an isometric view of the sealing system of the present invention in use.

Turning to FIG. 10, shown therein is an isometric view of the sealing system of the present invention in use. Depicted in FIG. 10 is the flexible sleeve 16 being sealed upon the electrical cords connectors 12. With the one end of the flexible polymer sleeve 16 secured to the electrical cord, the user secures the opposing end of the sleeve to the second electrical cord. The sealing tool 24 is positioned around the second glue line on the sleeve 16 and such the properly sized gauge jaw aperture 46 aligns with the cord. When in position, the user squeezes the handle 30 allowing heat transfer from the tool 24 to the glue. Both ends of the flexible polymer sleeve 16 are affixed at the glue lines to the electrical cords creating a moisture barrier at the electrical connection. Also shown are a seal 18, an aperture 48 of different size and the location 50 of the heating element in the tool 24.

What is claimed to be new and desired to be protected by Letters Patent is set forth in the appended claims:

1. A system for protecting mated electrical connectors disposed on ends of a pair of electrical cords, comprising:

a. a flexible sleeve having first and second ends and inner and outer surfaces, wherein the mated electrical connectors are placed inside said flexible sleeve between said first and second ends;

b. heat activated glue being disposed on said inner surface of each of said first and second ends of said flexible sleeve so that after said glue is heat activated a seal is formed around the mated electrical connectors and each of the ends of the pair of electrical cords; and, c. means for heating said heat activated glue whereby the heat activated glue is heated around each of the pair of electrical cords and first and second ends of the flexible sleeve thereby sealed to each of the electrical cords, wherein said means for heating comprises:

i. a tool having first and second members, said first and second members each having first and second ends, said first and second members being pivotally connected to each other;

ii. first and second mating jaws being disposed on said first end of said first and second members, each said jaw having a face thereon for mating to said face of the other jaw, each said face having a portion of a transverse aperture formed therein so that when said faces are mated to each other a completed transverse aperture is formed by said portions, said transverse aperture for receiving therein the electrical cord surrounded by said flexible sleeve having said heat activated glue thereon;

iii. wherein said first and second jaws are heated to permit the heat activated glue to be activated; and, iv. first and second handles being disposed on said second ends of said first and second members to permit a user to rasp the tool.

2. The system of claim 1, wherein said flexible sleeve comprises a polymer.

3. The system of claim 2, wherein said flexible sleeve is waterproof.

4. The system of claim 3, wherein said heat activated glue is a low temperature adhesive.

5. The system of claim 4, wherein said heat activated glue has a shape of a band.

6. The system of claim 4, wherein said seal is waterproof.

7. The system of claim 1, wherein said first and second jaws each comprise inner and outer jaws having a cartridge heater being disposed thereinbetween, wherein each said cartridge heater transfers heat from each said first and second jaw to said heat activated glue.

8. The system of claim 7, wherein each said inner and outer jaw are joined together by fasteners.

9. The system of claim 8, wherein said first and second jaws comprise a plurality of transverse apertures having different diameters for receiving various sizes of electrical cords.

10. The system of claim 9, wherein said first and second jaws are normally heated when said jaws are in a mated position.

11. The system of claim 10, wherein said first and second jaws are heated through an electrical circuit having power supplied by a DC power source, said DC power source comprising a battery being disposed in one of said handles of said tool.

12. The system of claim 10, wherein said first and second jaws are heated through an electrical circuit having power supplied by an AC power source.

* * * * *